US006652316B1

(12) United States Patent
Leifer et al.

(10) Patent No.: US 6,652,316 B1
(45) Date of Patent: Nov. 25, 2003

(54) ACCESSORY CONNECTOR FOR PORTABLE VIDEO GAME DEVICE

(75) Inventors: Robert Leifer, Dix Hills, NY (US); Gabe Neiser, Port Jefferson Station, NY (US)

(73) Assignee: Arista Enterprises, Inc., Hauppauge, NY (US)

( * ) Notice: Subject to any disclaimer, the term of this patent is extended or adjusted under 35 U.S.C. 154(b) by 57 days.

(21) Appl. No.: 09/969,827

(22) Filed: Oct. 3, 2001

Related U.S. Application Data

(60) Continuation-in-part of application No. 09/617,674, filed on Jul. 17, 2000, now Pat. No. 6,361,370, which is a division of application No. 09/590,992, filed on Jun. 9, 2000, now Pat. No. 6,280,327.

(51) Int. Cl.[7] ..... H01R 13/66
(52) U.S. Cl. ..... 439/576; 362/109
(58) Field of Search ..... 439/638, 639, 439/576; 362/109, 191, 234, 253, 396, 84, 85, 800, 311, 186

(56) References Cited

U.S. PATENT DOCUMENTS

| | | | | |
|---|---|---|---|---|
| 5,091,832 A | | 2/1992 | Tortola et al. | |
| 5,117,339 A | | 5/1992 | Tortola et al. | |
| 5,119,239 A | * | 6/1992 | Iaquinto et al. | 359/811 |
| 5,325,280 A | | 6/1994 | Tortola et al. | |
| 6,186,636 B1 | | 2/2001 | Naghi et al. | |
| 6,435,692 B1 | * | 8/2002 | Naghi et al. | 362/109 |

* cited by examiner

*Primary Examiner*—Jean F. Duverne
(74) *Attorney, Agent, or Firm*—Keusey, Tutunjian & Bitetto, P.C.

(57) ABSTRACT

An accessory connector for a portable video game device includes strategically disposed detents adapted to engage screw holes and indents in the top edge and back side of the game device. A snap over feature in the upper portion allows the connector to snap over the front top edge of the game device and secure the connector to the top edge of the game device. The detents disposed along an intermediary portion of the connector eliminates lateral sliding of the connector when operable disposed on the game device.

22 Claims, 19 Drawing Sheets

ACCESSORY CONNECTOR FOR PORTABLE VIDEO GAME DEVICE

CROSS-REFERENCE TO RELATED APPLICATIONS

This application is a Continuation-in-Part of U.S. patent application Ser. No. 09/617,674 filed Jul. 17, 2000 now U.S. Pat. No. 6,361,370, which is a Divisional of U.S. patent application Ser. No. 09/590,992 filed Jun. 9, 2000, now issued U.S. Pat. No. 6,280,327.

BACKGROUND OF THE INVENTION

1. Field of the Invention

The present invention related to portable video game devices, and more particularly to an accessory connector for portable video games.

2. Description of the Prior Art

Compact computers and video game devices having video viewing screens are becoming more and more popular and typically comprise hand-held portable, battery-operated devices. The viewing screen is typically a liquid crystal display (LCD) that is generally flat and displays information and or provides the screen for playing video games. Such compact computers and video games may include, but are not limited to: calculators, computer video games, lap top computers, and other computers where a variety of software is employed. In particular, compact video games, such as the compact video game systems known as GAME BOY™, GAME BOY POCKET™ and GAME BOY COLOR™ (Trademarks of Nintendo of America), and the new GAME BOY ADVANCE™ are completely self-sustained portable video game systems which may be operated by interchangeably employing a collection from a library of software game packs. These Nintendo video game systems provide a compact, self-contained, battery-operated, portable hand-held computer with a cross key joy stick (directional-pad or D-pad) to operate the game, start and select buttons, action buttons and an LCD-type screen, together with volume controls so as to display and enable the user to display images and play games.

While video display screens are employed and typically include a flat LCD-type screen, such LCD-type display screens are often difficult to observe by the user in partial or low light conditions, such as, for example, automobiles, planes, trains, buses, and the like due to the lack of illumination on the LCD screen to permit suitable contrast during use.

U.S. Pat. Nos. 5,091,832, 5,325,280, 5,117,339 and 5,165,779 show various light devices for use with compact video game screens. In each instance the ability to slidably and releasable attach the device directly to the game device using recessed grooves in the body of the game device is significant in the operation of the device.

U.S. Pat. No. 6,186,636 shows another light device for a compact video screen of a portable game device. This light device attaches to the game device through its connection to the game device's link port, and includes a structurally flexible and supportive wire that retains a light in an adjustable position.

SUMMARY OF THE INVENTION

It is an object of the invention to provide an apparatus for attaching accessory devices to hand-held video games.

It is another object of the invention to provide an apparatus and method for attaching an accessory device to a hand-held video game that does not interfere with the operation of the game.

It is yet another object of the invention to provide an apparatus and method for attaching an accessory device to a hand-held video game that utilizes unique features of the hand-held video game device in order to secure attachment thereto.

These and other objects are achieved in accordance with an embodiment of the present invention in which the portable video game device has a front, a back and a top edge extending from the front to the back. The accessory connector includes a housing having an upper portion, a lower portion and an intermediary portion connecting the upper and lower portion. Each of the portions have an internal and an external surface. A first connection means is integrally formed with the lower portion for engaging the back of the portable video game device. A second connection means is integrally formed with the upper portion for engaging the front of the portable video game device, and a securing means is disposed on at least one of said upper, intermediary and lower portions for laterally securing the accessory connector to the top edge of the portable video game device.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numeral denote similar components throughout the views.

DETAILED DESCRIPTION OF PREFERRED EMBODIMENTS

Figure 1:
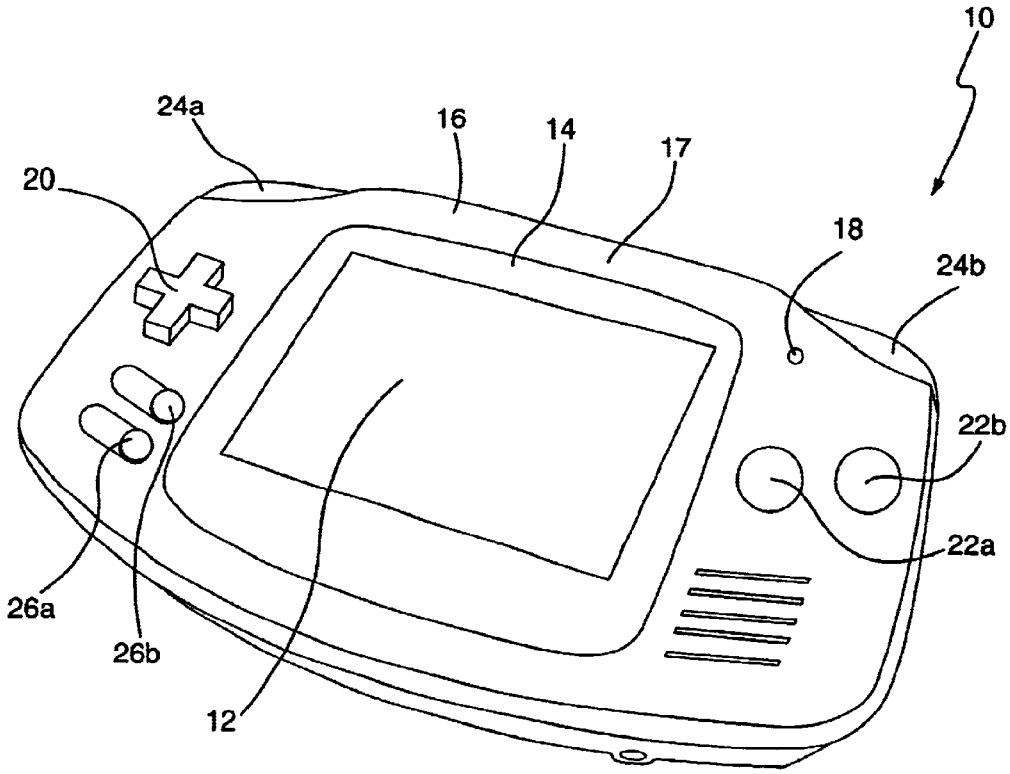
FIG. 1 is a perspective view of a hand held video game device.
Figure 2:
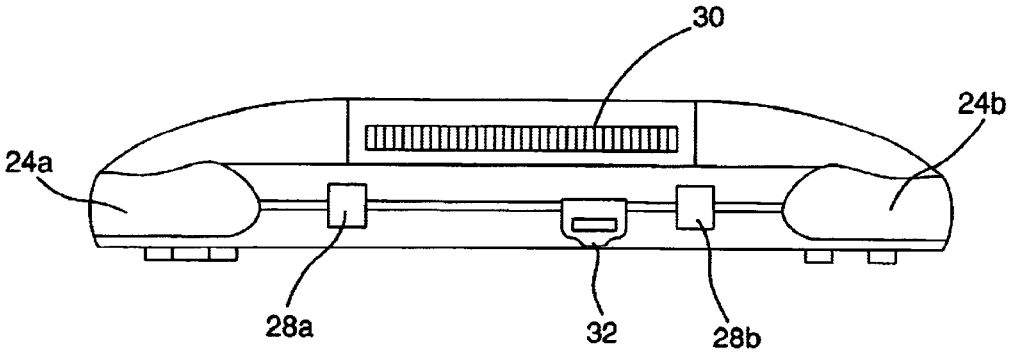
FIG. 2 is top view of the hand held video game device.
Figure 3:
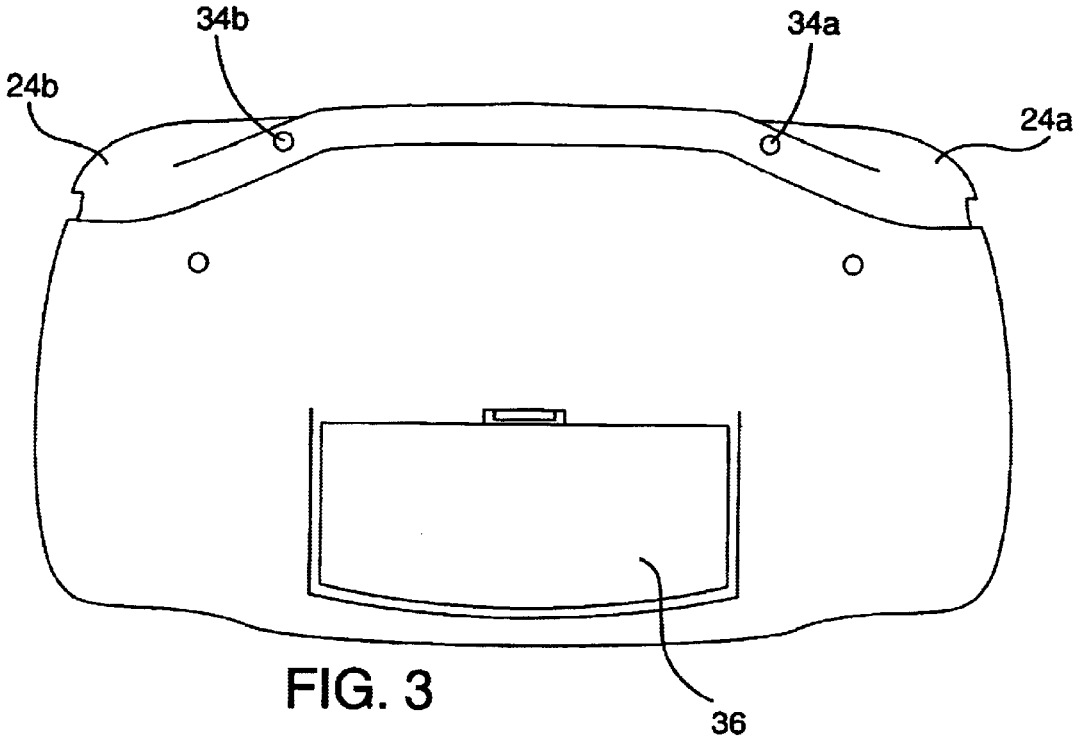
FIG. 3 is a rear view of the hand held video game device.
Figure 4:
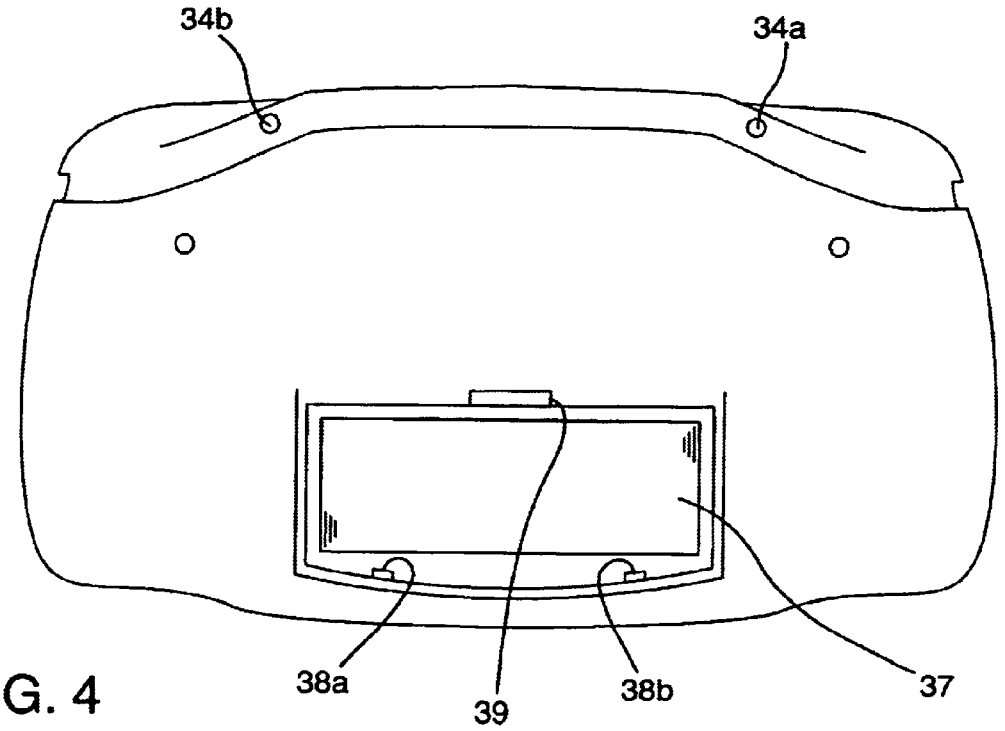
FIG. 4 is a rear view of the hand held video game device with the battery compartment cover removed.

Referring to FIGS. 1 through 4, there is shown a portable game device 10 that is representative of a new generation in portable game devices. This game device 10 is manufactured by Nintendo and is commonly known as the GAME BOY ADVANCE™. The portable game device 10 includes a video display screen 12, a display screen border 14 and a housing 16. A power indicator 18 lights up when the power to the game device is on, and control D-pad 20 and control buttons 22*a*, 22*b*, 24*a* and 24*b* enable user control of a video game being played.

The top edge of game device 10 shows the disposition of the game cartridge slot 30 on the rear of the device and communication port 32. A pair of indents 28*a* and 28*b* are disposed on the top edge. On the rear of device 10, there are screw holes 34*a* and 34*b* through which screws (not shown) secure the game device together during assembly. The battery compartment 37 is disposed on the rear of the game device and includes a battery compartment cover 36 enclosing the same. As is known in the art, battery compartment 37 includes openings 38*a* and 38*b* and 39 for receiving corresponding parts of the battery compartment cover 36 to secure the same to the game device.

Figure 5:
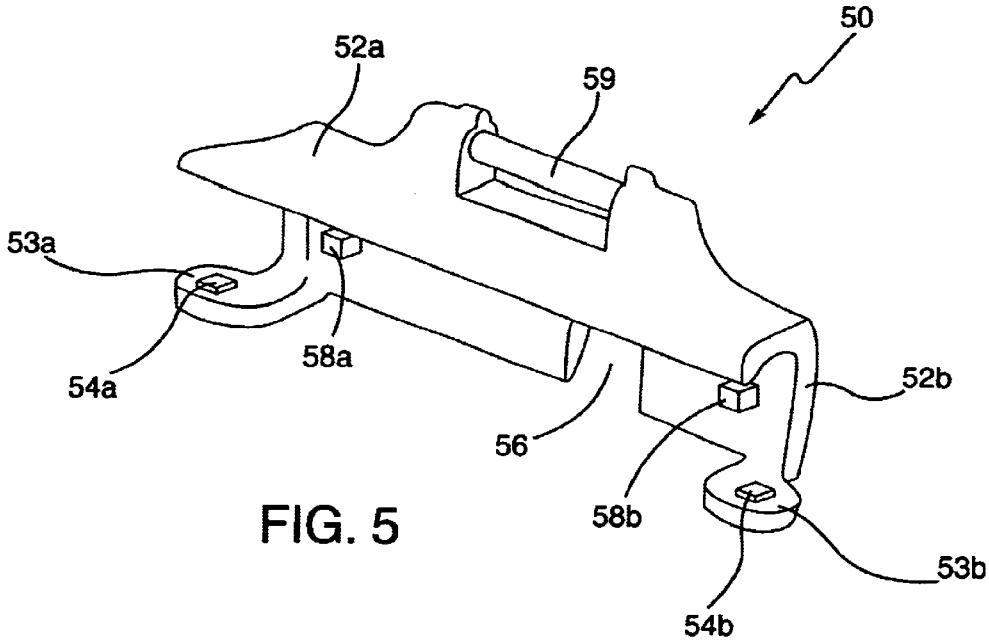
FIG. 5 is a perspective view of the accessory connector according to first embodiment of the invention.

FIG. 5 shows the accessory connector 50 according to a first embodiment of the invention. Accessory connector 50 includes an upper portion 52*a* adapted to engage over the top edge of the game device 10 and secure over the transitional front top edge 17 of housing 16 and onto the video display border 14 (to be discussed later with reference to FIG. 8*b*). An intermediary portion 52*b* connects the upper portion 52*a* to the lower portion formed by a pair of extensions 53*a* and 53*b*. Extensions 53*a* and 53*b* of the lower portion are provided to grip the underside of the game device while the upper portion 52*a* engages the top of the game device. Extensions 53*a* and 53*b* include corresponding detents 54*a* and 54*b* that are shaped and positioned to engage the screw holes 34*a* and 34*b* in the back of the game device. In addition, another pair of detents 58*a* and 58*b* are positioned on the inside of connector 50 so as to engage the corresponding indents 28*a* and 28*b* in the top edge of the game device.

Figure 8A:
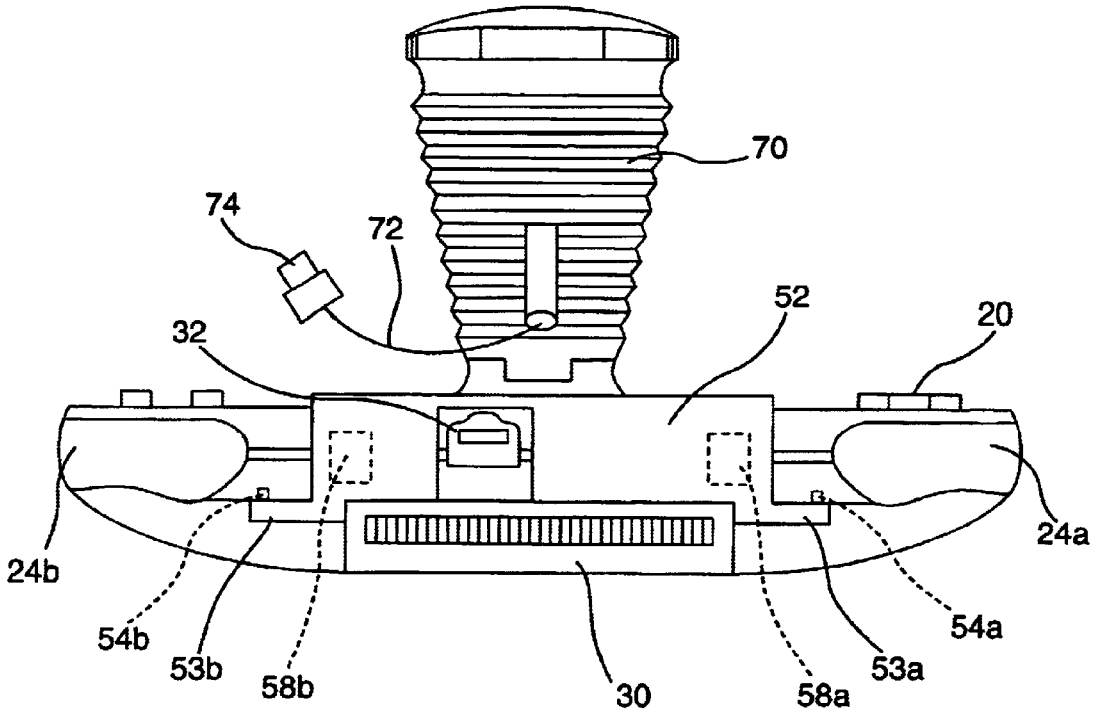
FIG. 8*a* is a top edge view of the accessory connector of the first embodiment of the invention as connected to the portable video game device.
Figure 8B:
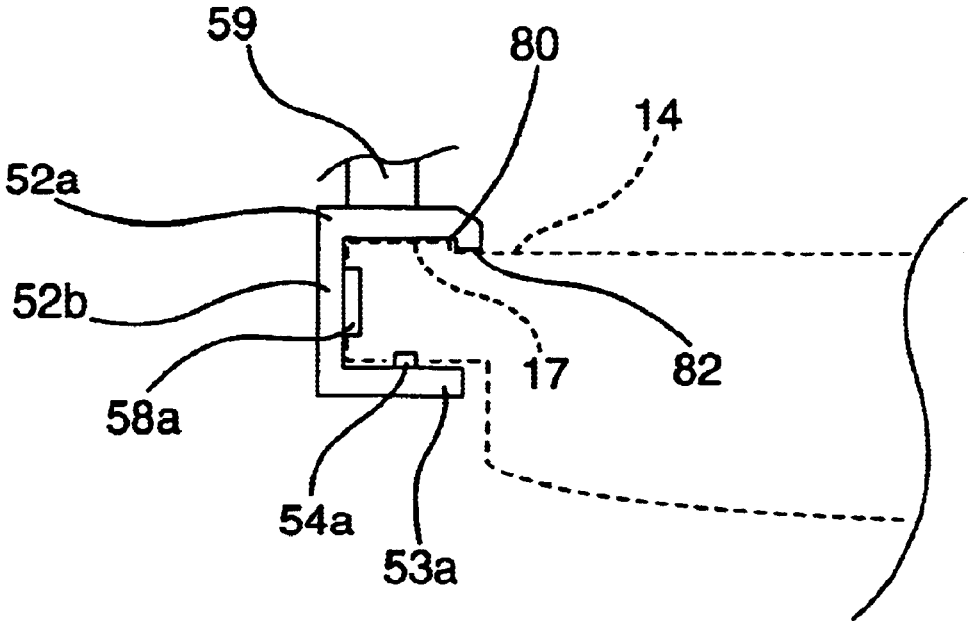
FIG. 8*b* is a cross-sectional view showing the engagement of the accessory connector with the portable game device according to the first embodiment of the invention.

Referring to FIGS. 5, 7, 8*a* and 8*b*, when connector 50 is attached to the game device 10, the detents 54*a* and 54*b* engage screw holes 34*a* and 34*b* while extensions 53*a* and 53*b* of the lower portion do not interfere with the access to the game cartridge slot 30. As shown in FIG. 8*b*, the display border 14 is slightly recessed from the front top edge 17 of housing 16. The upper portion 52*a* of the connector includes an underside 80 that passes over front top edge 17 and at the point of transition between front top edge 17 and display border 14 (i.e., where the display boarder is recessed), a downward protrusion 82 snaps over the ledge formed between front top edge 17 and display border 14. This "snap over" feature operates in conjunction with the detents 54*a*, 54*b*, 58*a* and 58*b* to secure connector 50 onto the top edge of the game device. The detents 54*a*, 54*b*, 58*a* and 58*b* also operate to laterally secure the connector 50 to the game device and prevent sliding of the same along the top edge of the game device.

By way of example, the accessory can be a light assembly 70 connected to the connection part 59 of the connector 50 in order to illuminate the video display screen 12 in low light conditions. The opening 56 in the connector 50 provides clear access to the communication port 32, and thereby enables the connection of a plug 74 to the communication port 32 of the game device for the purpose of powering the connected accessory. The plug 74 is connected to the light assembly 70 by a flexible wire 72.

Figure 6:
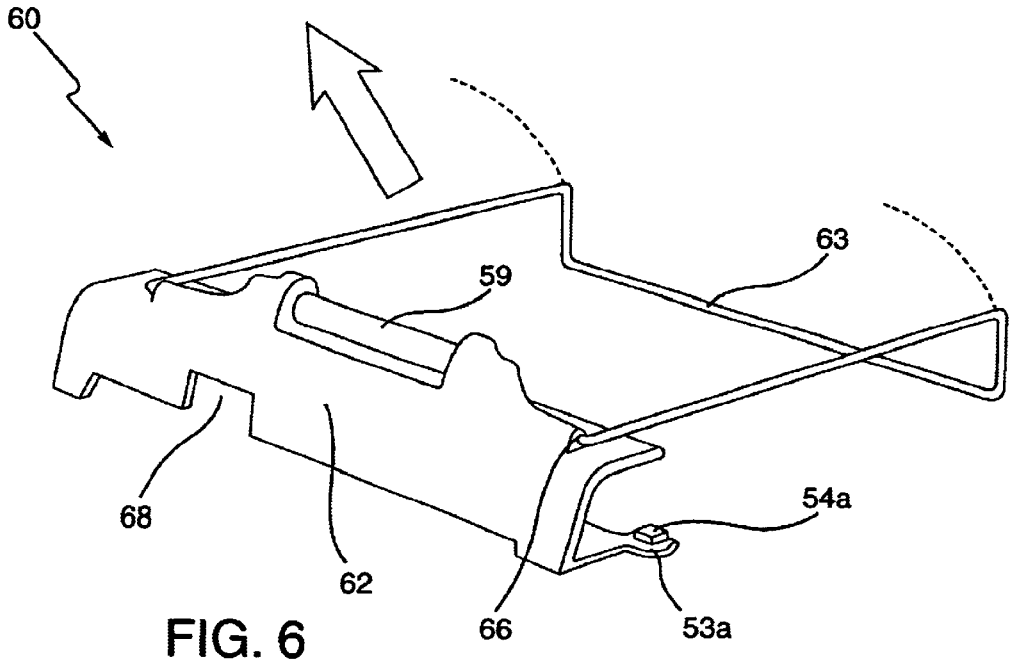
FIG. 6 is a perspective view of the accessory connector according to a second embodiment of the invention.
Figure 7:
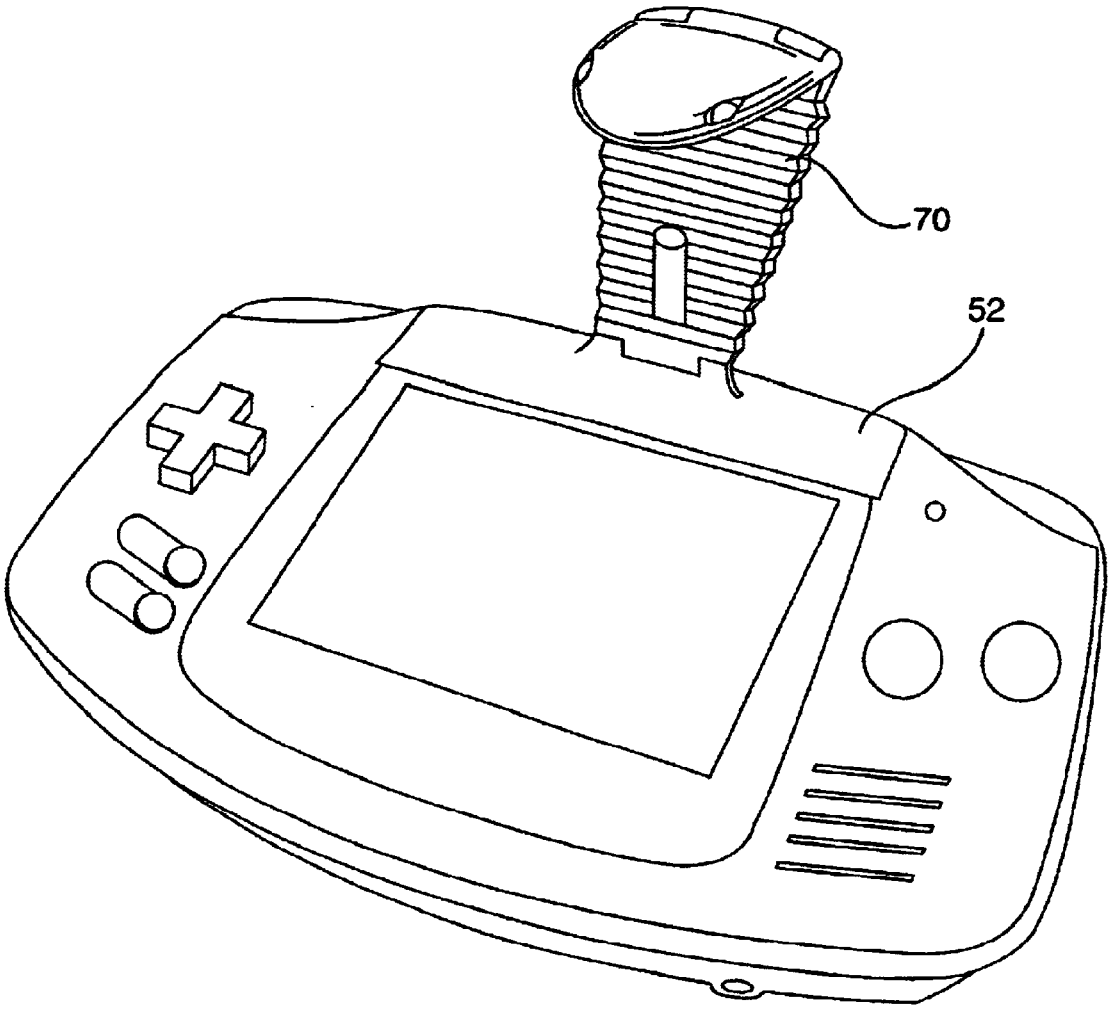
FIG. 7 is a perspective view of the accessory connector of the first embodiment having a light apparatus attached thereto.
Figure 9:
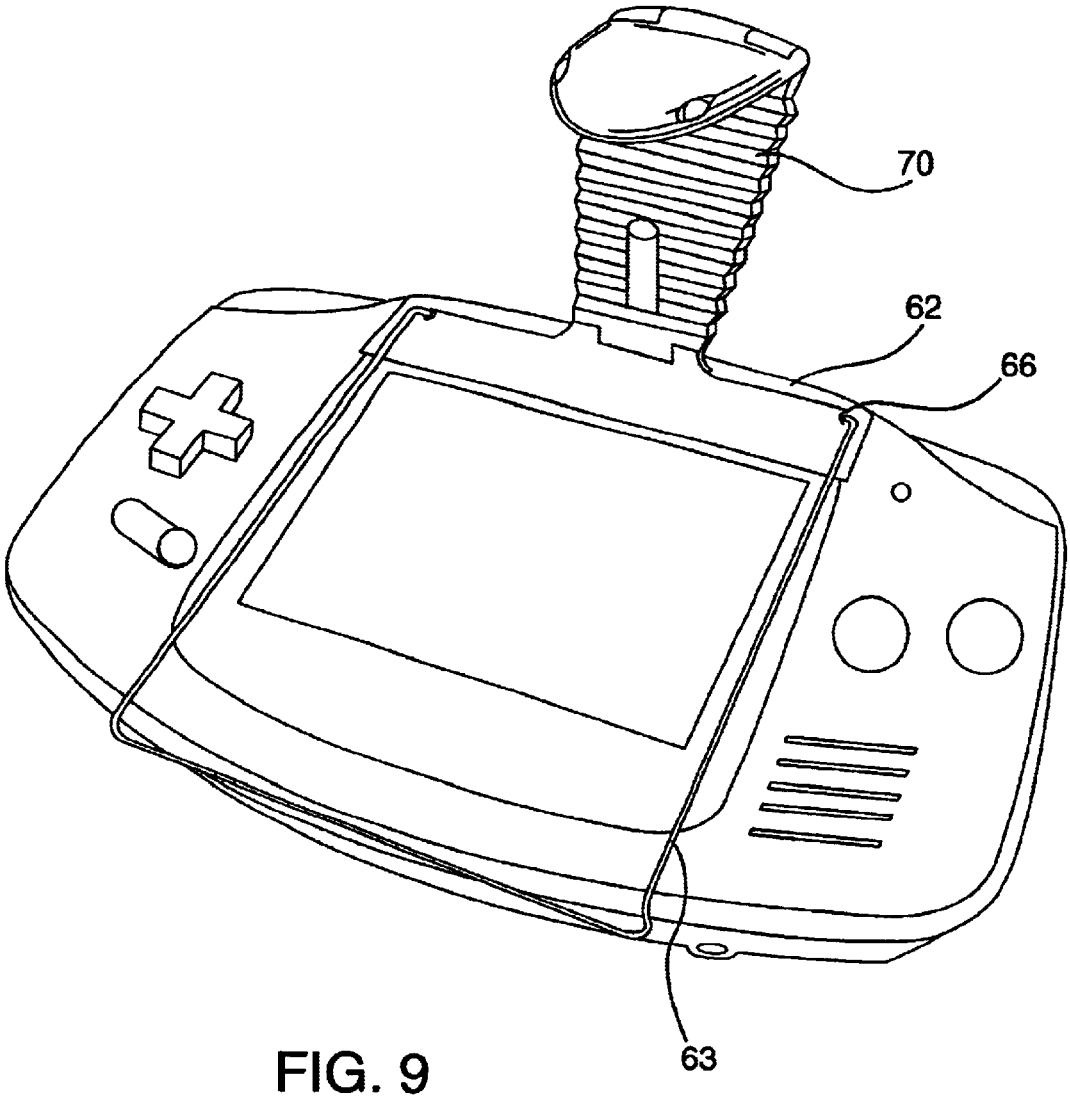
FIG. 9 is a perspective view of the accessory connector of the second embodiment connected to the portable game device.
Figure 10:
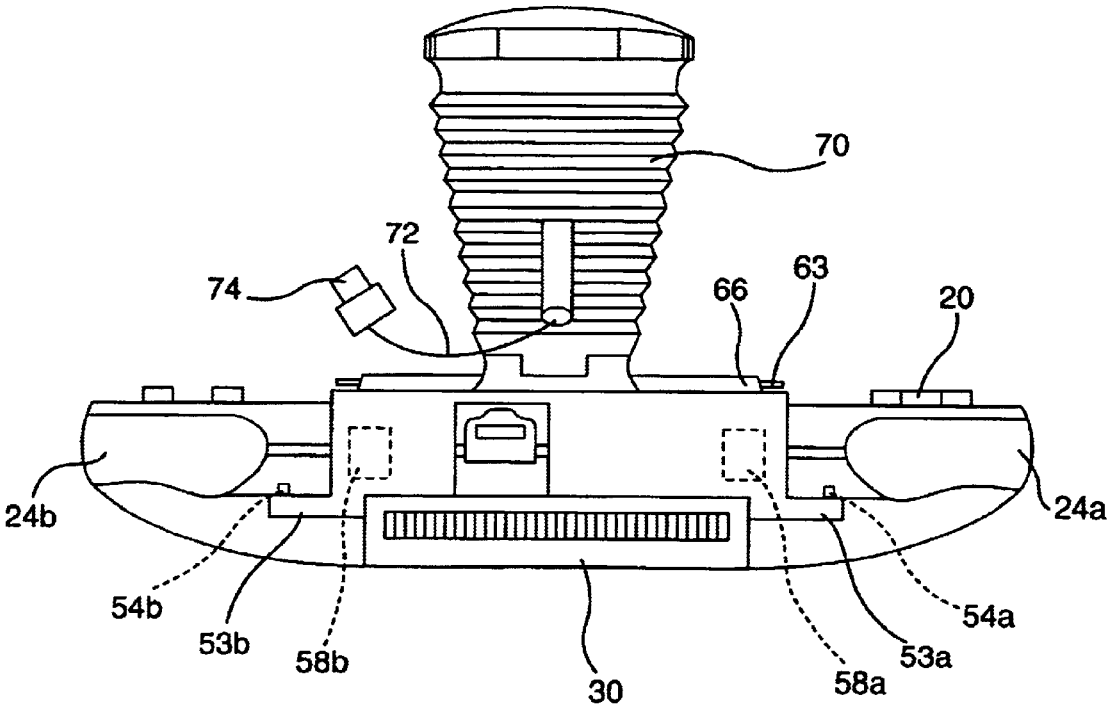
FIG. 10 is a top edge view of the accessory connector of the second embodiment of the invention as connected to the portable video game device.

Referring to FIGS. 6, 9 and 10, there is shown the accessory connector 60 according to a second embodiment of the invention. Connector 60 includes the same extensions 53*a* and 53*b* and corresponding detents 54*a* and 54*b*, respectively, for connection to the underside of the game device. The upper portion of connector 60 includes a securing clip 63 that is pivotally mounted onto connector 60 via a hinge 66. Once connector 60 is mounted on the top edge of the game device, clip 63 passes over the game device and engages the bottom edge of the same (FIGS. 9 and 10). Thus, it is clear that clip 63 is bent such that is securely engages the game device on the bottom edge thereof opposite the connector 60 disposed on the top edge.

Figure 11:
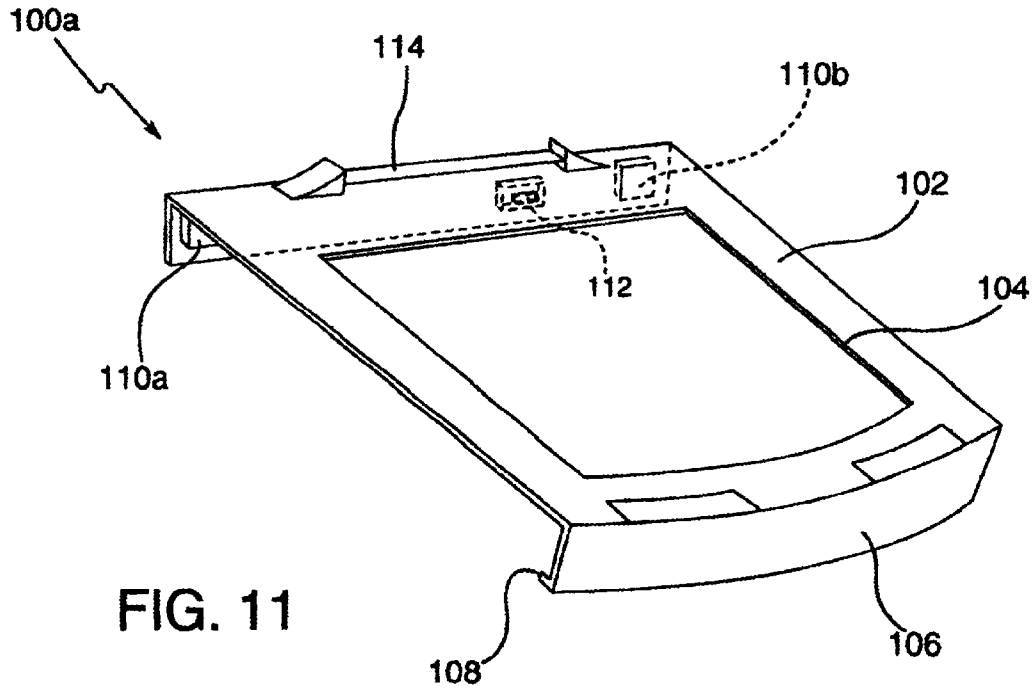
FIG. 11 is a perspective view of the accessory connector according to a third embodiment of the invention.
Figure 13:
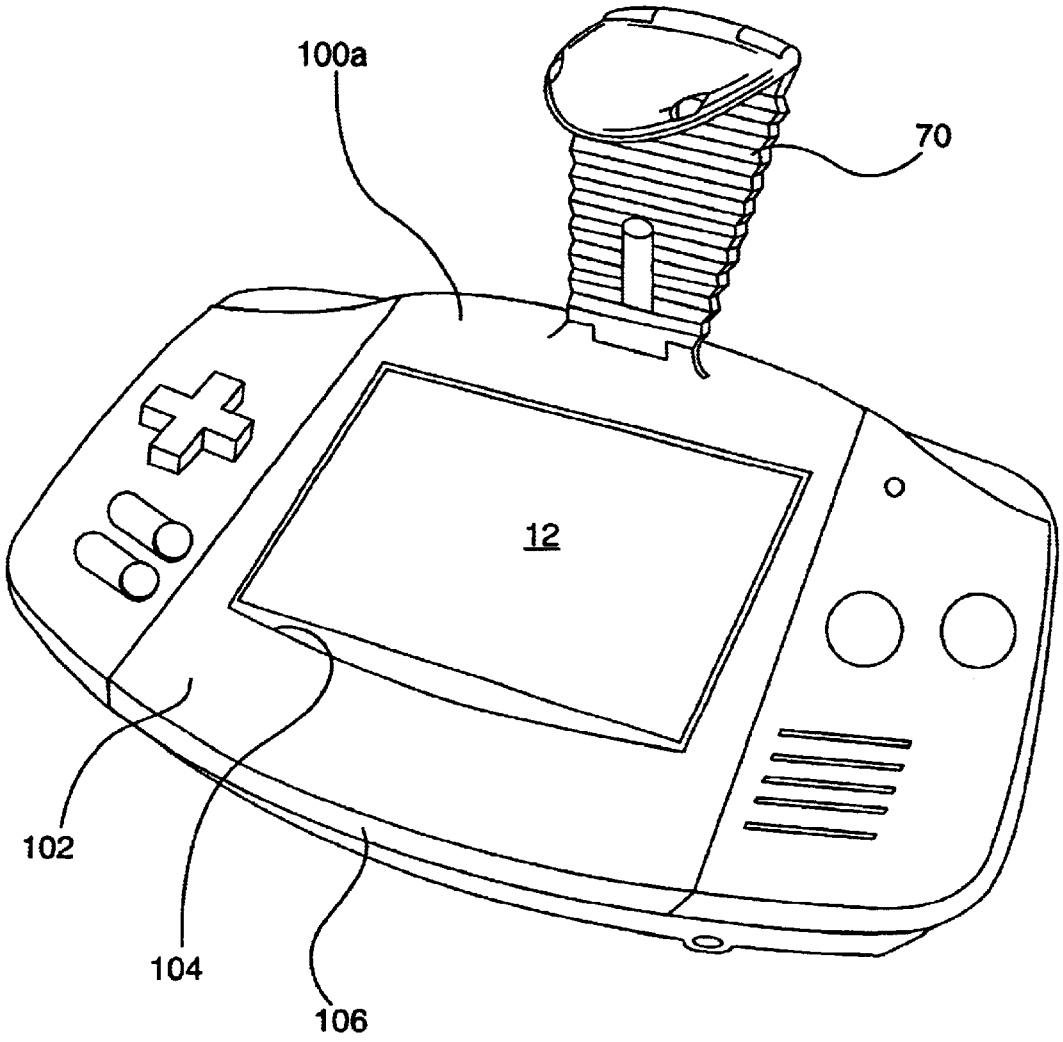
FIG. 13 is a perspective view of the accessory connector of the third embodiment connected to the portable game device.
Figure 14:
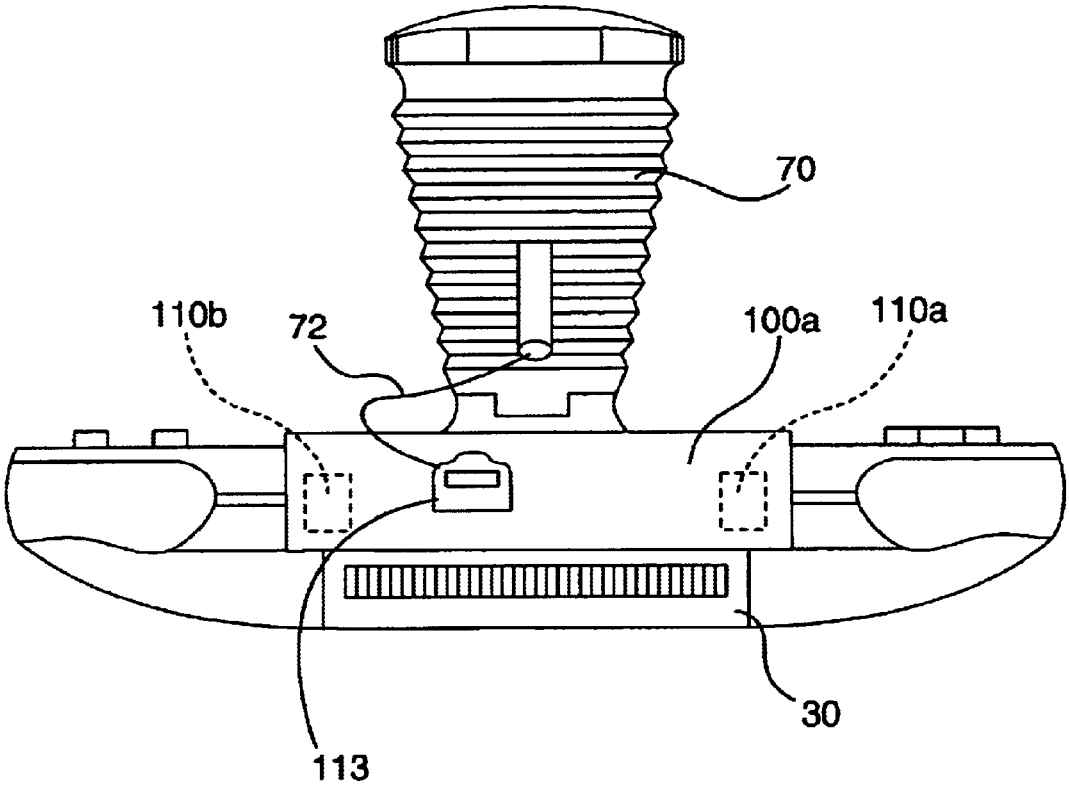
FIG. 14 is a top edge view of the accessory connector of the third and fourth embodiments of the invention as connected to the portable video game device.

Referring to FIGS. 11, 13 and 14, there is shown the connector 100*a* according to the third embodiment of the invention. Connector 100*a* has a frame 102 having an opening 104 sized to expose the entire video display 12 of the game device. A pair of detents 110*a* and 110*b* are positioned on the inside surface of the connector and are aligned so as to engage the respective indents 28*a* and 28*b* on the top edge of the game device. A plug 112 is also disposed on the inside surface of the connector and aligned to engage the link port 32. Plug 112 can be used to provide power to the accessory device attached to the connector 110*a*. The front or lower edge portion 106 extends downward from frame 102 and includes a lip 108. Lip 108 engages under the front bottom edge of the game device and helps to secure the connector 100*a* to the game device.

FIGS. 13 and 14 show the connector 100*a* when attached to the game device and having a light assembly 70 attached thereto. In this embodiment, the light assembly 70 is electrically connected to plug 112 via wire 72. Plug 112 includes a pass through plug 113 that provides secondary access to the game link port 32 when plug 112 is disposed in the link port 32.

Figure 12:
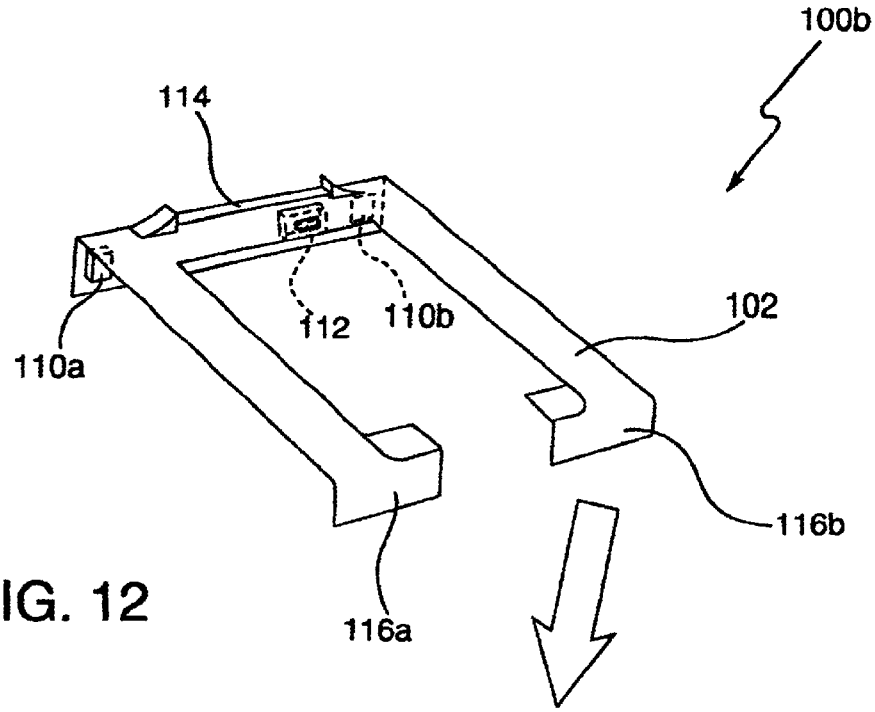
FIG. 12 is a perspective view of the accessory connector according to a fourth embodiment of the invention.
Figure 17:
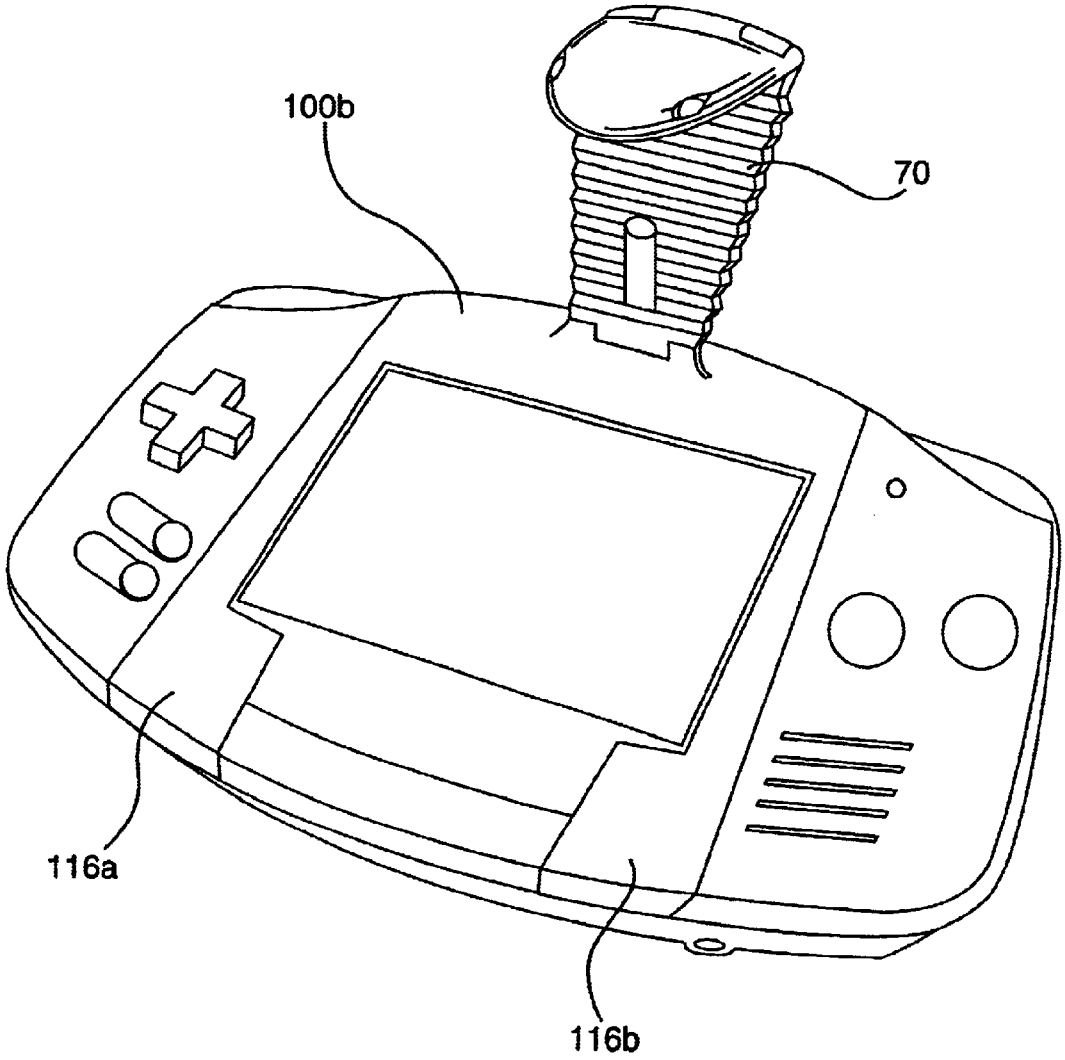
FIG. 17 is a perspective view of the accessory connector of the fourth and sixth embodiments connected to the portable game device.

FIGS. 12, 14 and 17 show the connector 100*b* according to a fourth embodiment of the invention. The only difference is that connector 100*b* has two legs 116*a* and 116*b* that provide a more flexible connection with the game device than that of the one piece structure of connector 100*a*. Connector 100*b* engages the game device in substantially the same manner as that of connector 100*a*, and may or may not include a lip 108 to engage the front bottom edge of the game device.

Figure 15:
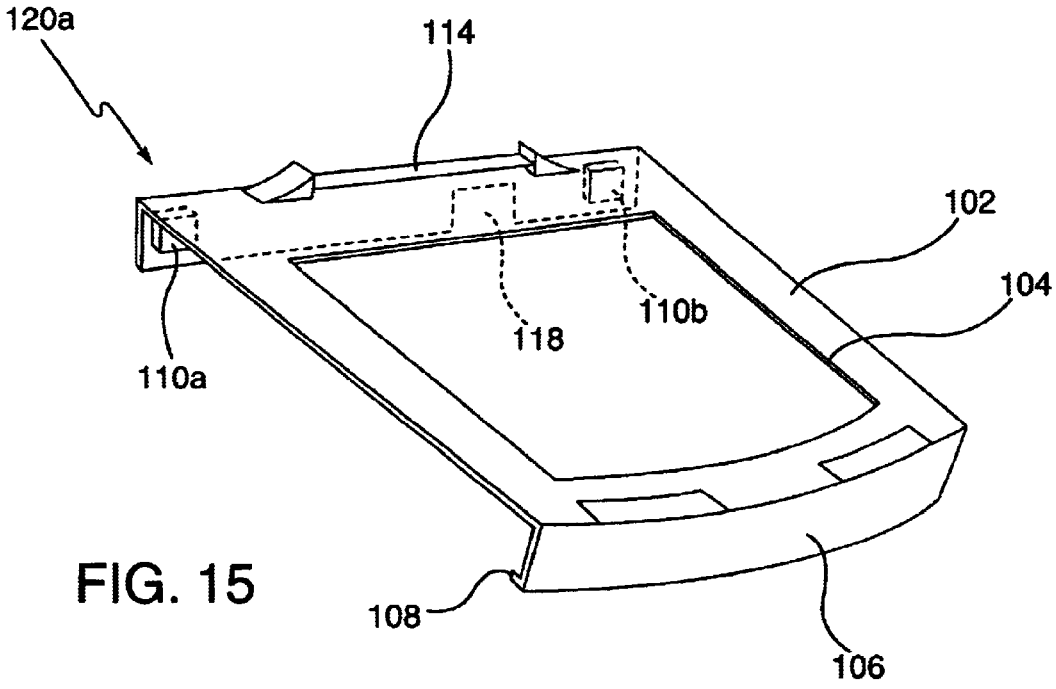
FIG. 15 is a perspective view of the accessory connector according to a fifth embodiment of the invention.
Figure 16:
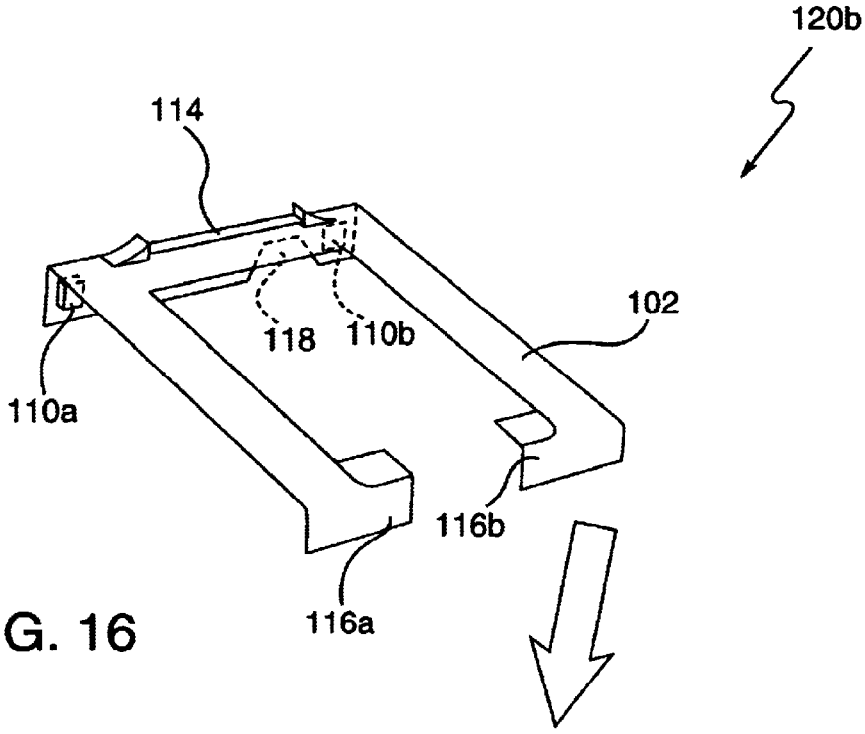
FIG. 16 is a perspective view of the accessory connector according to a sixth embodiment of the invention.
Figure 18:
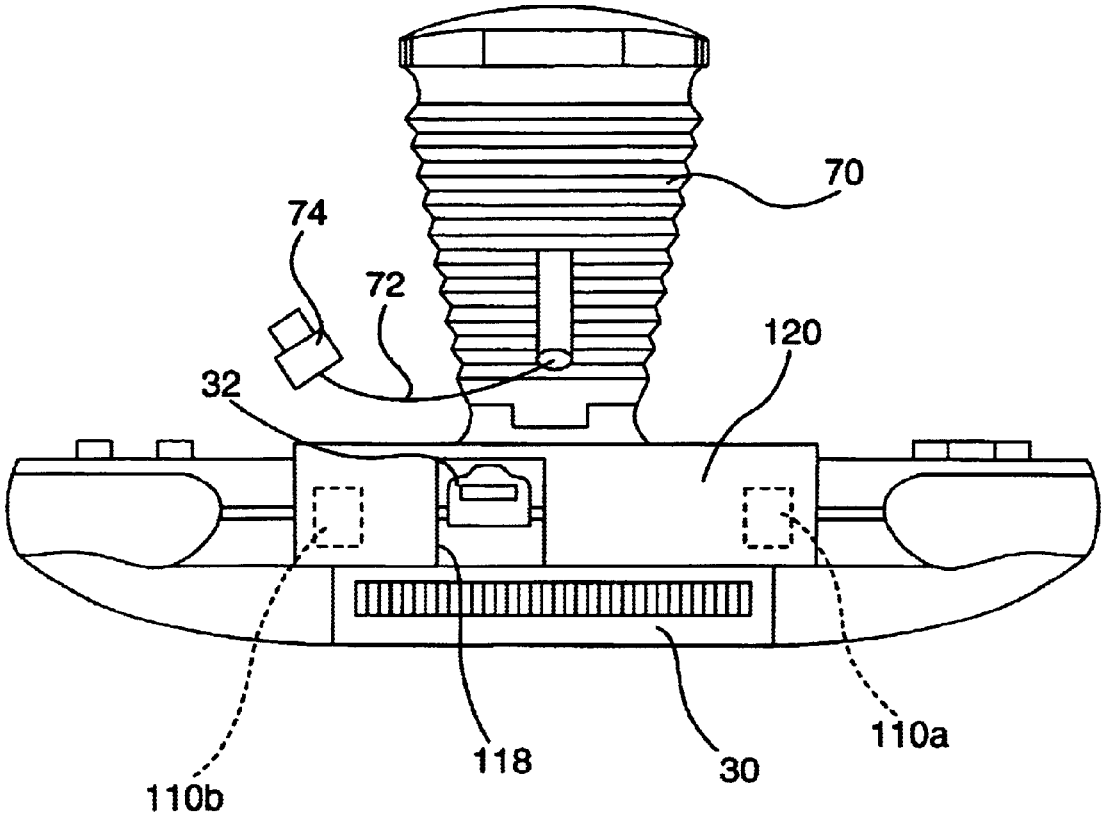
FIG. 18 is a top edge view of the accessory connector of the third and fourth embodiments of the invention as connected to the portable video game device.

FIGS. 15, 16 and 18 show revised connectors 120*a* and 120*b* according to fifth and sixth embodiments of the invention. The difference here is that a window 118 replaces the internal side plug 112 (FIGS. 11 and 12). Through the implementation of windows 118, the light assembly 70 can be electrically connected to the link port 32 using a plug 74 and corresponding wire 72.

Figure 19:
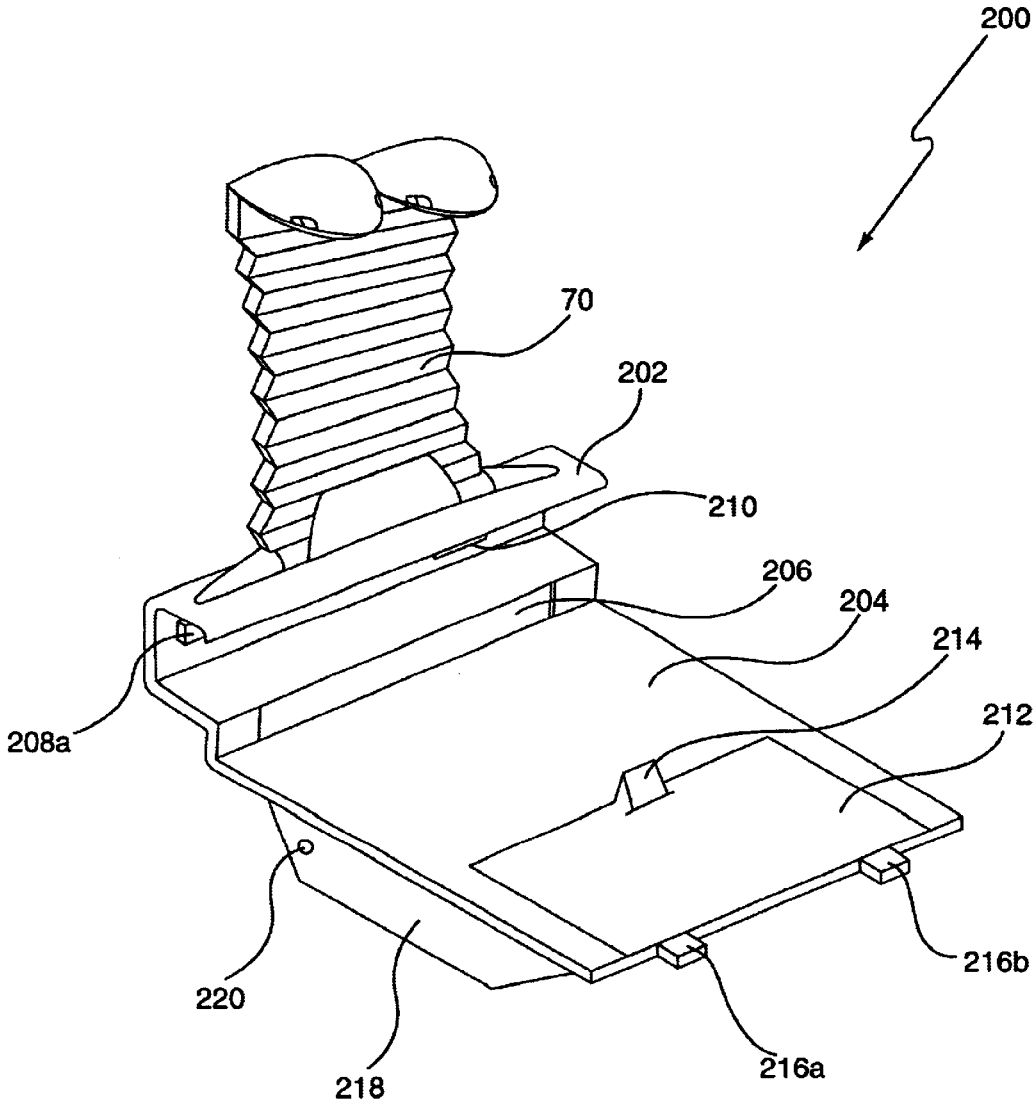
FIG. 19 is a perspective view of the accessory connector according to a seventh embodiment of the invention.
Figure 20:
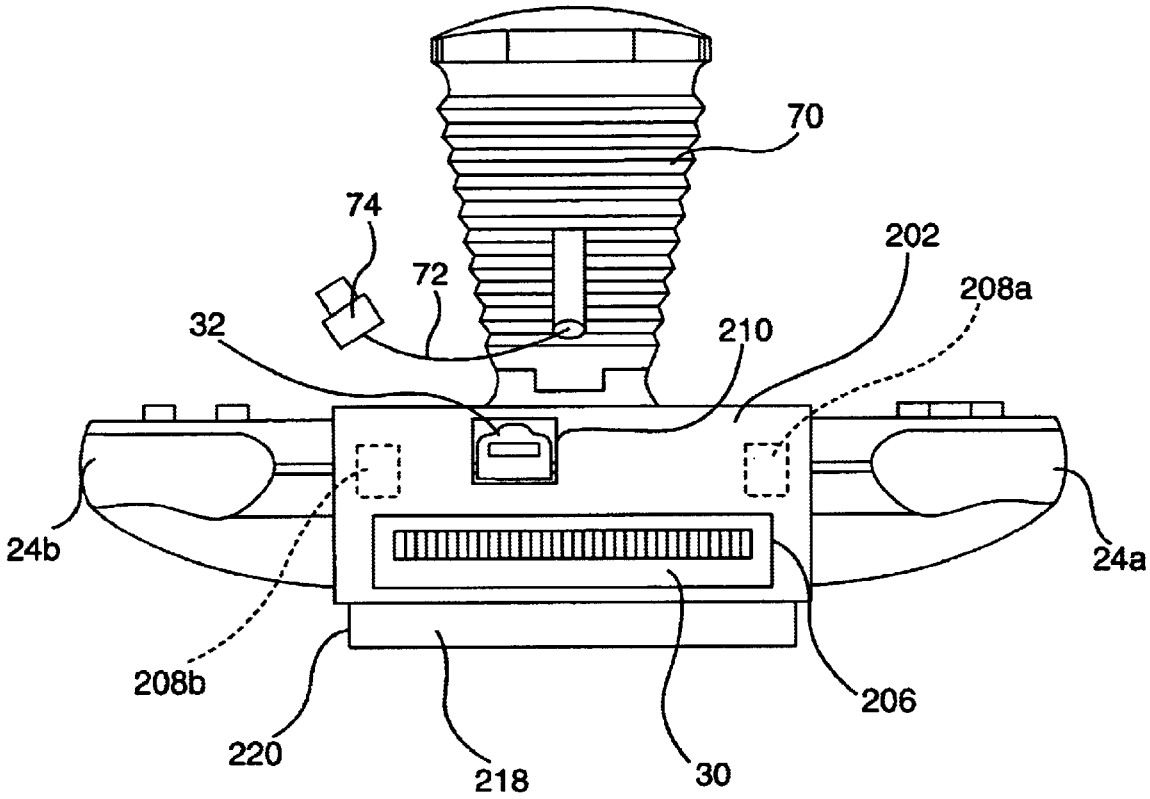
FIG. 20 is a top edge view of the accessory connector of the seventh embodiment as connected to the portable video game device.
Figure 21A:
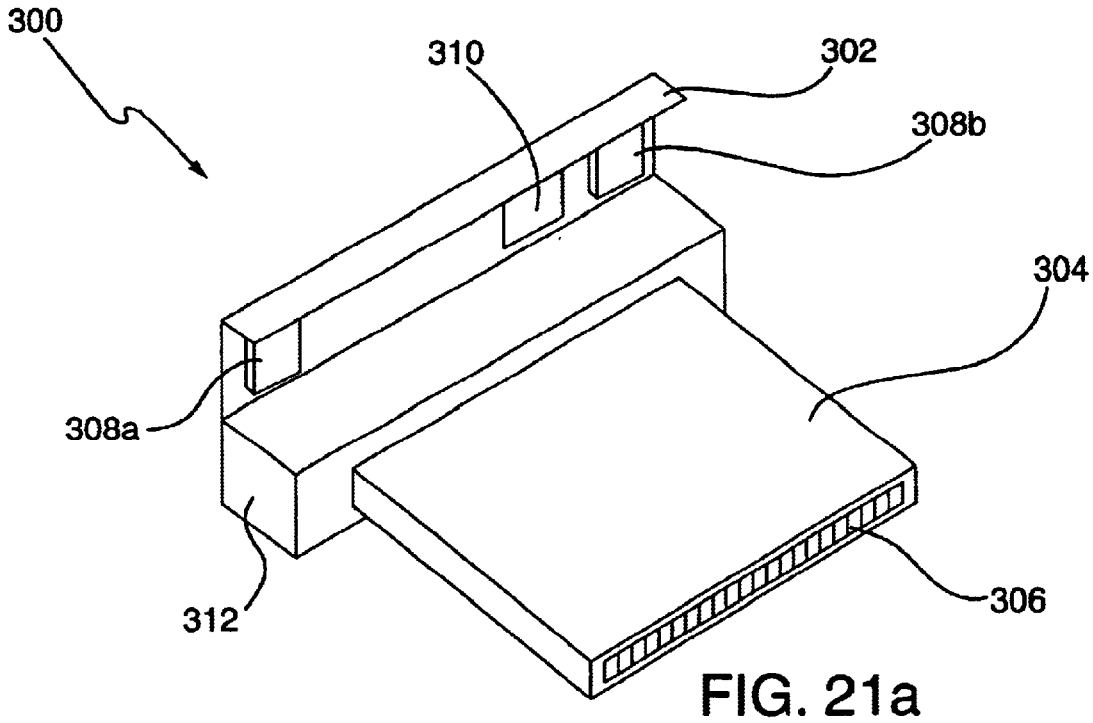
FIG. 21*a* is a perspective view of the accessory connector according to an eighth embodiment of the invention.
Figure 21B:
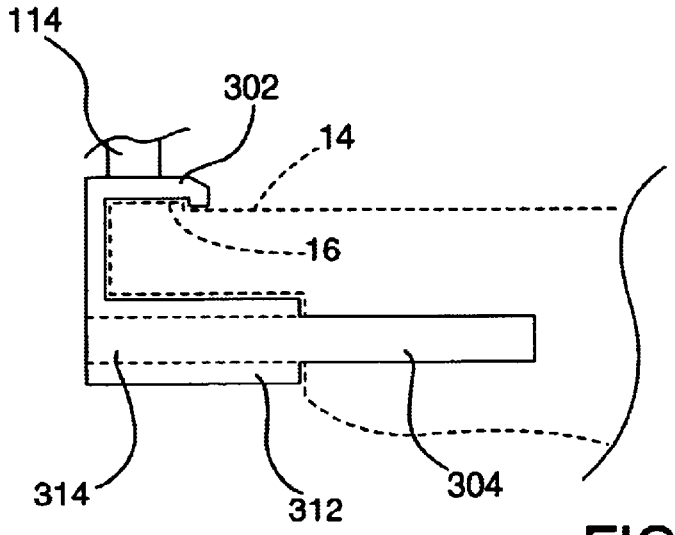
FIG. 21*b* is a side view of the accessory connector according to the eighth embodiment of the invention.

FIGS. 19, 20 and 21 show the accessory connector 200 according to a seventh embodiment of the invention. Connector 200 includes an upper portion 202, a lower portion 204 and a game cartridge opening 206 interposed between upper and lower portions 202 and 204, respectively. The lower portion 204 includes a battery compartment cover 212 integrated therein and including a battery compartment clip 214 and battery compartment detents 216*a* and 216*b*. The clip 214 and detents 216*a* and 216*b* engage the respective clip receiving opening 39 and detent holes 38*a* and 38*b* in the game device to aid in the securing of the connector 200 to the game device. In one embodiment, connector 200 can include a battery pack 218 having a connection plug 220.

The upper portion 202 includes a link port window 210 and detents 208*a* and 208*b* for engaging the corresponding indents 28*a* and 28*b* on the game device. As shown in FIG. 20, when connector 200 is attached to the game device, access to the game cartridge slot 30 is still available, and the accessory (e.g., light assembly 70) can be electrically connected to the game device through link port 32 or to the onboard battery pack 218 via plug 220. Those of ordinary skill will recognize that the configuration of plug 74 can be changed without departing from the spirit of the invention.

Figure 22A:
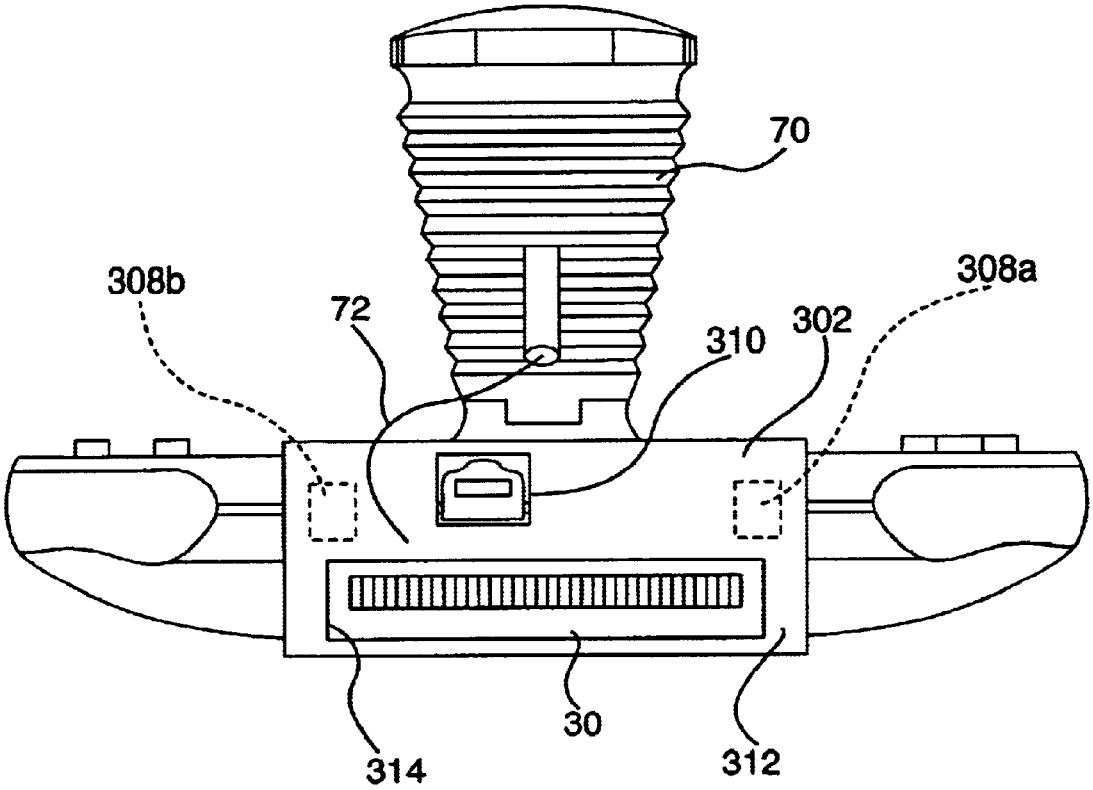
FIG. 22*a* is a top edge view of the accessory connector of the eighth embodiment as connected to the portable video game device.
Figure 22B:
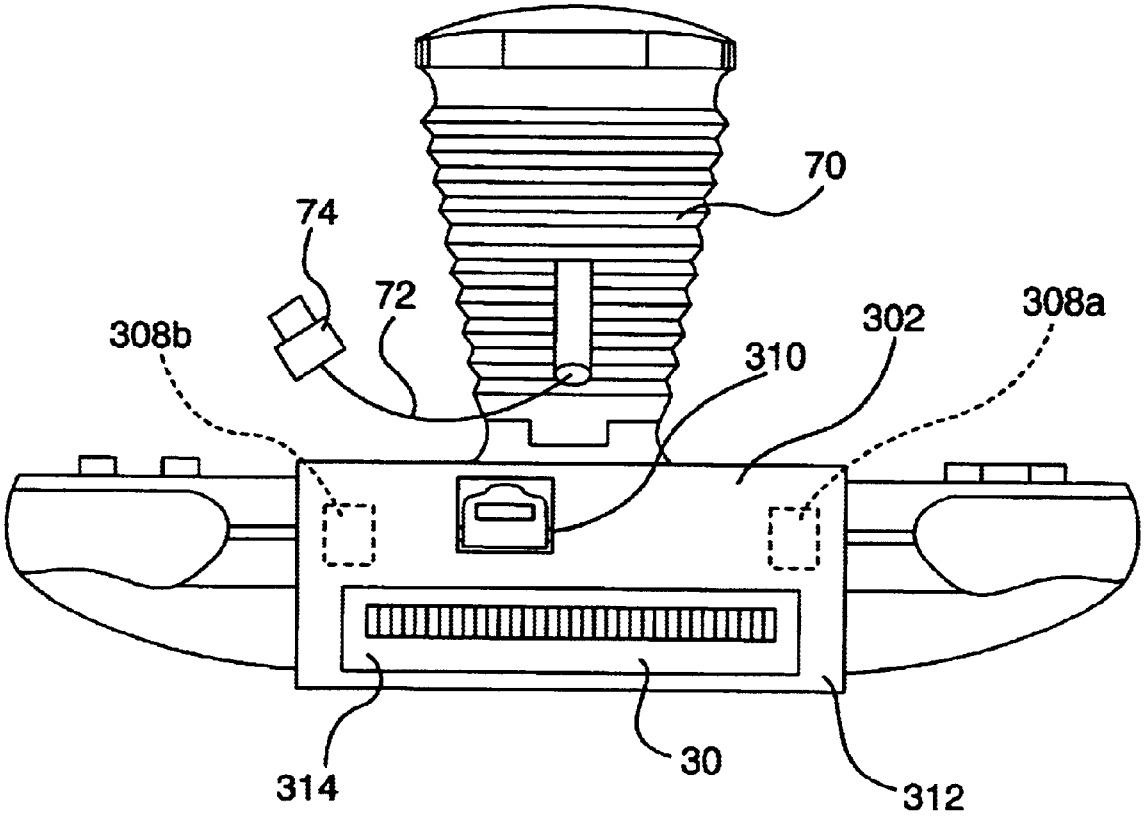
FIG. 22*b* is a top edge view of the accessory connector of the eighth embodiment as connected to the portable video game device and having a modified electrical connection.

FIGS. 21 and 22 shows the accessory connector 300 according to an eighth embodiment of the invention. Connector 300 includes an upper portion 302, a main portion 312 connected to the upper portion 302 and a game cartridge slot engaging portion 304 connected to the main portion 312. The upper portion 302 may include detents 308*a* and 308*b* that operate as explained previously to engage the indents 28*a* and 28*b* on the top edge of the game device. In addition, upper portion 302 can be adapted to engage the top edge of the game device as previously described with reference to the embodiment of FIG. 8*b*.

An opening 314 in main portion 312 receives the game cartridge that would otherwise be disposed in slot 30 and is now occupied with slot engaging portion 304. The slot engaging portion 304 includes a connector 306 that matingly engages the game cartridge slot and allows the accessory connector to obtain power for the connected accessory device through the game cartridge slot. A wire 72 can thereby electrically connect the connected accessory (e.g., light assembly 70) to the game device through the main housing and game cartridge slot 30. AS window 310 in the upper portion 302 allows for access to the link port 32 while the accessory connected is disposed in its operable position on the game device.

While there have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An accessory connector for a portable video game device having a front, a back and a top edge extending from the front to the back, the accessory connector comprising:

a housing having an upper portion, a lower portion and an intermediary portion connecting said upper and lower portion, each of said portions having an internal and an external surface;

first connection means integrally formed with said lower portion for engaging the back of the portable video game device;

second connection means integrally formed with said upper portion for engaging the front of the portable video game device; and securing means disposed on at least one of said upper, intermediary and lower portions for laterally securing the accessory connector to the top edge of the portable video game device.

2. The accessory connector according to claim 1, wherein said first connection means comprises at least one detent disposed on the internal surface of said lower portion for engaging at least one screw hole in the back of the game device.

3. The accessory connector according to claim 1, wherein the portable video game device further comprises a video screen, a cover panel covering the video screen and a front top edge extending from said cover panel to the top edge, said cover panel being slightly recessed from said upper edge to form a ledge, said second connection means comprising an elongated upper surface having a downward extending flange adapted to snap over the upper edge of said compact computer device and engage the ledge formed between said upper edge and the cover panel.

4. The accessory connector according to claim 1, wherein said securing means comprises at least one detent disposed on said internal surface of said intermediary portion, said at least one detent engaging a corresponding indent in the top edge of the portable game device.

5. The accessory connector according to claim 1, wherein said lower portion engages the back of the portable game device and includes a pair of extensions flared outward from said intermediary portion and positioned so as to not interfere with a game cartridge slot disposed on the back of the portable game device.

6. The accessory connector according to claim 1, wherein said intermediary portion comprises an opening for accommodating a link port disposed on the top edge of the game device.

7. The accessory connector according to claim 1, wherein said upper portion further comprises a connection part for selectively receiving an accessory device to be connected to the portable game device with the accessory connector.

8. The accessory connector according to claim 1, wherein said second connection means comprises an elongated upper surface having a downward extending flange adapted to snap over the upper edge of said portable video game device and engage the ledge formed between said upper ledge and the cover panel.

9. An accessory connector for a portable video game device having a front, a back, a top edge extending from the front to the back, a video screen, a cover panel covering the video screen and a front top edge extending from said cover panel to the top edge, said cover panel being slightly recessed from said upper edge to form a ledge, the accessory connector comprising:

a housing having an upper portion, a lower portion and an intermediary portion connecting said upper and lower portion, each of said portions having an internal and an external surface, said lower portion comprising two opposing extensions adapted to engage the back of the portable game device and first connection means for engaging the back of the portable video game device;

second connection means integrally formed with said upper portion for engaging the front of the portable video game device; and securing means disposed on at least one of said upper, intermediary and lower portions for laterally securing the accessory connector to the top edge of the portable video game device.

10. The accessory connector according to claim 9, wherein the elongated surface is adapted to provide pressure against the front of the portable video game device to keep the downward extending flange in position when the downward extending flange is snapped over the upper edge of the portable video game device.

11. The accessory connector according to claim 9, wherein said first connection means is disposed on said two opposing extensions.

12. The accessory connector according to claim 9, wherein said securing means comprises at least one detent disposed on said internal surface of said intermediary portion, said at least one detent engaging a corresponding indent in the top edge of the portable game device.

13. The accessory connector according to claim 9, wherein said lower portion engages the back of the portable game device and includes a pair of extensions flared outward from said intermediary portion and positioned so as to not interfere with a game cartridge slot disposed on the back of the portable game device.

14. The accessory connector according to claim 9, wherein said upper portion further comprises a connection part for selectively receiving an accessory device to be connected to the portable game device with the accessory connector.

15. An accessory connector for a portable video game device having a front, a back, a top edge extending from the front to the back, a video screen, a cover panel covering the video screen and a front top edge extending from said cover panel to the top edge, said cover panel being slightly recessed from said upper edge to form a ledge, the accessory connector comprising:

a housing having an upper portion, a lower portion and an intermediary portion connecting said upper and lower portion, each of said portions having an internal and an external surface;

first connection means integrally formed with said lower portion for engaging the back of the portable video game device;

second connection means integrally formed with said upper portion for engaging the front of the portable video game device; and at least one detent disposed on said internal surface of said intermediary portion for engaging a corresponding indent in the top edge of the portable game for laterally securing the accessory connector to the top edge of the portable video game device.

16. The accessory connector according to claim 15, wherein said first connection means comprises at least one detent disposed on the internal surface of said lower portion for engaging at least one screw hole in the back of the game device.

17. The accessory connector according to claim 15, wherein said second connection means comprises a downward extending flange formed on said upper portion and adapted to snap over the upper edge of said portable video game device and engage the ledge formed between said upper edge and the cover panel.

18. The accessory connector according to claim 15, wherein said upper portion further comprises a connection part for selectively receiving an accessory device to be connected to the portable game device with the accessory connector.

19. An accessory connector for a portable video game device having a front, a back, a top edge extending from the front to the back, a video screen, a cover panel covering the video screen and a front top edge extending from said cover panel to the top edge, said cover panel being slightly recessed from said upper edge to form a ledge, the accessory connector comprising:

a housing having an upper portion, a lower portion and an intermediary portion connecting said upper and lower portion, each of said portions having an internal and an external surface;

first connection means integrally formed with said lower portion for engaging the back of the portable video game device;

second connection means integrally formed with said upper portion for engaging the front of the portable video game device, said second connection means including a downward extending flange formed on said upper portion and adapted to snap over the upper edge of said portable video game device and engage the ledge formed between said upper edge and the cover panel; and securing means disposed on at least one of said upper, intermediary and lower portions for laterally securing the accessory connector to the top edge of the portable video game device.

20. The accessory connector according to claim 19, wherein said first connection means comprises at least one detent disposed on the internal surface of said lower portion for engaging at least one screw hole in the back of the game device.

21. The accessory connector according to claim 19, wherein said securing means comprises at least one detent disposed on said internal surface of said intermediary portion, said at least one detent engaging a corresponding indent in the top edge of the portable game device.

22. The accessory connector according to claim 19, wherein said upper portion further comprises a connection part for selectively receiving an accessory device to be connected to the portable game device with the accessory connector.

* * * * *